United States Patent [19]

Zingeser

[11] Patent Number: 4,775,057

[45] Date of Patent: Oct. 4, 1988

[54] STORAGE SHELF UNIT FOR SYRINGES AND NEEDLES

[76] Inventor: Emanuel R. Zingeser, 24522 Curtis, Southfield, Mich. 48075

[21] Appl. No.: 88,555

[22] Filed: Aug. 24, 1987

[51] Int. Cl.[4] ..... A47F 7/00

[52] U.S. Cl. ..... 211/133; 206/366; 211/10; 211/60.1

[58] Field of Search ..... 211/10, 49.1, 60.1, 211/70.6, 126, 133, 135; 206/366

[56] References Cited

U.S. PATENT DOCUMENTS

| | | | |
|---|---|---|---|
| D. 95,328 | 4/1935 | Ginsburg | 211/10 X |
| 1,189,371 | 7/1916 | Lyons | 211/126 X |
| 1,662,637 | 3/1928 | Chase | 211/126 |
| 2,934,214 | 4/1960 | Mogulescu et al. | 211/126 |
| 3,195,480 | 7/1965 | Meyer | 211/44 X |
| 3,269,788 | 8/1966 | Knee | 211/10 X |
| 3,430,774 | 3/1969 | Karkut | 211/10 X |

FOREIGN PATENT DOCUMENTS

| | | | |
|---|---|---|---|
| 267918 | 7/1950 | Switzerland | 211/10 |

*Primary Examiner*—Robert W. Gibson, Jr.

*Attorney, Agent, or Firm*—Cullen, Sloman, Cantor, Grauer, Scott and Rutherford

[57] ABSTRACT

A shelf unit for visibly storing an assortment of elongated, generally cylindrically shaped articles, such as packaged syringes and syringe needles and the like shaped articles, is formed by a rear wall and opposed side walls, with a rearwardly tilting lower shelf, a rearwardly tilting intermediate shelf and a forwardly tilting upper shelf extending between the walls. A short, front wall extends between the side walls and the front lower edge of the upper shelf so that the front of the shelf unit is open below the shelf unit. Spaced apart vertical dividers are located in the spaces between the shelves to form separate, forwardly opening compartments of predetermined sizes adapted to receive and separate articles of different sizes within the compartments. A series of vertical dividers extend between the front short wall and the rear wall at the upper shelf to form upwardly opening compartments upon the upper shelf adapted to receive articles arranged generally parallel to the front wall. The walls and shelves may be made of a plastic material which is substantially transparent so that the various articles within the compartments are readily visible.

2 Claims, 1 Drawing Sheet

STORAGE SHELF UNIT FOR SYRINGES AND NEEDLES

BACKGROUND OF THE INVENTION

This invention relates to an improved shelf unit which is particularly useful for storing and sorting a variety of size and shape packaged medical syringes and syringe needles in a veterinary medicine facility.

In a veterinary hospital or similar medical facility, a relatively large assortment of different sizes, shapes and types of hypodermic syringes and syringe needles are required for use with the different sizes, shapes and types of animals. Typically, syringes are packaged in elongated tubes, similar to test tubes, with covers for sterile sealing them within the package or in elongated tube-like envelopes which are sterile. In some cases, the syringe may be packaged with its needle. In other cases, the syringe may be packaged separately from the needle. In those instances, the needle is packaged within its own elongated test tube-like or capsule-like package. In use, a veterinarian or assistant must open the elongated, generally cylindrically or tubularly shaped package, to remove the syringe and, in the cases where the syringe needle is not already in place upon the syringe, must open the needle package for removing the needle and placing it upon the end of the syringe.

Since syringes and syringe needles are ordinarily used once and then discarded, rather than sterilized for additional use, it is necessary for a typical veterinary facility to have a relatively large number of syringes and needles on hand for selection and use as needed in the treatment of animals. Usually, when the syringes are needed and when a predetermined size needle is required with a particular syringe, the selection from the storage compartments or boxes must be made rapidly and with accuracy. Ordinarily, packaged syringes and needles are kept within the containers in which they are sold, which makes it difficult and relatively time consuming to quickly locate the correct size or type syringe and needle. Frequently, boxes or loose packaged syringes and needles are loosely kept on open shelves in cabinets or in drawers where they tend to mix together. Thus, they are difficult to rapidly recognize and select.

This invention is concerned with a shelf unit which facilitates sorting or separation of different types and sizes of hypodermic syringes and related needles and enables rapid selection when needed. However, while focused upon the peculiar need of the veterinary medical facility, the shelf unit also may be adapted to storing and sorting other types of generally similarly shaped articles, that is, articles which may be relatively long and tubular or cylindrical, or where a number of such articles may be stored together but must be separately selected from among the collection.

SUMMARY OF THE INVENTION

This invention contemplates a shelf unit having side walls, a back wall and an open front with several vertically spaced apart shelves. The lower shelves are tilted rearwardly downwardly and the uppermost shelf is tilted forwardly and downwardly. A forward wall closes the space between the leading edge of the uppermost shelf and the side walls to form an upwardly opening space, as contrasted with the forwardly opening space between the other shelves. Suitable vertical dividers may divide the spaces into compartments which are roughly sized to receive and store elongated articles of about the same size or shape so that different kinds and sizes of articles may be sorted within the different compartments.

Preferably, the shelf unit is formed of a transparent or substantially transparent, rigid plastic material so that the articles contained within the compartments are visible from all directions. Thus, the shelf unit, first, sorts the units by compartments and, second, enables rapid visual identification. Third, the open compartments facilitate removing the articles from the shelf unit when desired.

The upper compartments may be sized so that typical packaged syringe needles, which are contained with an elongated, closed capsule-like tube, may be arranged axially parallel to the front and rear walls so that the needles are sorted by the widths of the compartments. The syringes or the like elongated articles may be placed within the lower compartments with their axes running from front to rear and sloped downwardly toward the rear. This permits better sorting and stacking within the respective compartments as well as easy withdrawal of the articles from each of the compartments.

One object of this invention is to provide an inexpensive shelf unit for sorting and enabling visual identification of a substantially large number of relatively elongated, cylindrical-like or tubular articles, especially collections of different size and shape packages of hypodermic needles and syringes and the like.

Another object of this invention is to provide a compartmentalized shelf unit which is sufficiently open to enable rapid removal and insertion of groups of similar sized or shaped articles and also, to facilitate maintaining the cleanliness of the unit. Since the unit is essentially transparent, any lack of cleanliness is quickly observable which encourages frequent and adequate cleaning of the unit as required.

These and other objects and advantages of this invention will become apparent upon reading the following description, of which the attached drawings form a part.

DETAILED DESCRIPTION

Figure 1:
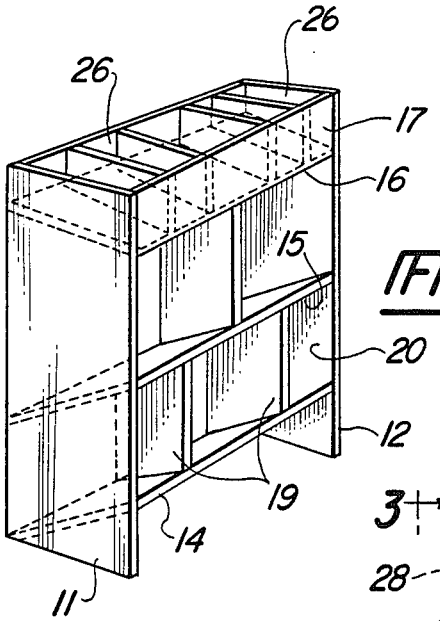
FIG. 1 is a perspective view of the shelf unit of this invention.

Referring to the drawings, the shelf unit comprises a back wall 10 and side walls 11 and 12 which are secured to the back wall. The unit includes a lower shelf 14, an intermediate shelf 15 and an upper shelf 16. A low front wall 17 extends between the side walls along the front edge of the upper shelf.

The lower and intermediate shelves tilt downwardly and rearwardly, that is, from the open front of the unit towards the rear wall of the unit. However, preferably the upper shelf tilts reversely, that is, forwardly and downwardly. The angle of tilting relative to the horizontal may be varied. However, an operative example of a unit for the intended purpose includes about a 15! downward tilt, relative to the horizontal, for both the intermediate and lower shelves. The upper shelf is tilted at a lesser angle, such as roughly 10! or between about 5–10! from the horizontal.

Vertical dividers 19 are arranged between the intermediate and lower shelves to provide forwardly opening, lower compartments 20. Similarly, at least one vertical divider 19 is arranged between the upper shelf and intermediate shelf to provide at least two intermediate compartments 23. As shown in the drawings, the use of two vertical dividers 19 and one vertical divider 22, above it, produces a number of compartments of different sizes.

In addition, a number of vertical dividers 25 are arranged between the rear or back wall 10 and the front wall 17, upon the upper surface of the upper shelf 16. This produces a number of upwardly opening compartments 26 which may be of the same size, but preferably are of different sizes, as shown by the center compartment in FIG. 2.

The entire unit is made of a plastic sheet material, using a suitable, commercially available plastic which is sufficiently strong enough for this purpose. Preferably, the material is completely transparent, but it may be substantially transparent, that is, less than glass-like in transparency. In either event, the unit may be sufficiently transparent so the contents of the compartments are readily visible from all directions, that is, through the walls, dividers and shelves.

The unit may be used by simply standing it upright, as for example shown in FIG. 1. Alternatively, it may be mounted against a wall or support, using mounting holes 28 in the rear wall as a means for suspending the shelf unit upon hooks or for receiving nails or screws that may be used for securing the shelf unit upon a supporting wall.

Figure 7:
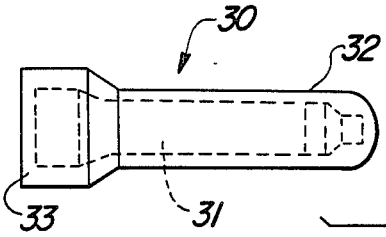
FIG. 7 schematically illustrates a typical packaged hypodermic syringe and an adjacent hypodermic syringe needle for use with that syringe.
Figure 7:
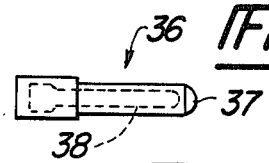

The shelf unit, although useful for a variety of elongated, tube-like groups of articles, is especially useful for storing and sorting the relatively large number of a wide variety of hypodermic syringes and syringe needles typically found in a veterinary hospital. Thus, FIG. 7 schematically illustrates a typical hypodermic syringe package 30 having a syringe 31 encapsulated within a rigid test tube-like package 32 closed by a suitable cap 33. Alternatively, the package may be of a flexible, generally tubular, envelope type (not shown). The size of the packaged syringe varies considerably depending upon the nature and construction of the syringe. For example, some syringes may be as long as five inches or more, and others may be shorter. In the case of hypodermic syringes that are used with interchangeable different size needles, it is conventional to package the needles in needle packages 36 which comprise capsule-like tubes 37 or generally tubular envelopes, each containing a particular length and diameter needle 38. The tubes may be formed, like long medicine capsules, in two parts with one part telescoped in the other to form the complete package. Different size needles may be packaged in different size, shape or color containers.

Figure 8:
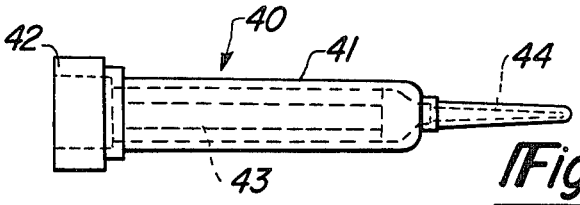
FIG. 8 schematically illustrates a typical packaged hypodermic syringe with an attached syringe needle.

FIG. 8 schematically illustrates an alternative style of hypodermic syringe package 40. This comprises an elongated tube 41 of varying diameter, with a cover 42. The package contains a syringe 43 upon which a needle 44 is affixed.

In typical use, because of the difficulty, expense and relative unreliability of sterilizing hypodermic syringes and their needles, it is common to obtain the syringes and their needles in sterilized condition. After the cap of the package is removed and the syringe and needle are removed from their packages they are used once and then are discarded. However, in these cases where syringe or needle are to be sterilized and reused they may be repackaged into their containers and returned to the shelf unit.

Figure 2:
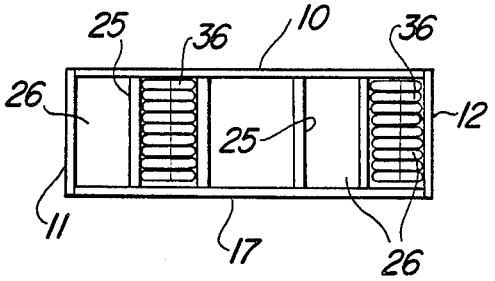
FIG. 2 is a top, plan view of the shelf unit, to an enlarged scale, illustrating two of the compartments filled with packaged hypodermic needles.
Figure 3:
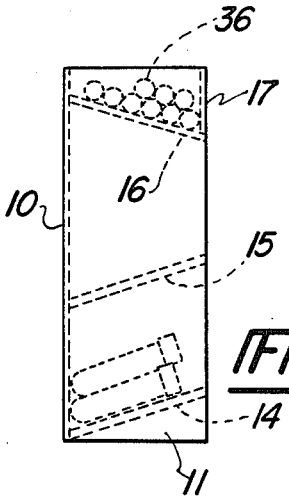
FIG. 3 is a side, elevational view taken in the direction of arrow 3—3 of FIG. 4.

A typical veterinary hospital has a large number of groups of different size, shape and style syringes and needles. Thus, as illustrated in FIG. 2, the packaged needles are preferably arranged within the upwardly opening compartments 26 with their axes arranged generally parallel to the front and rear walls. Preferably, the width of each compartment is selected to match a conventional size needle package. For example, one typical needle size package is about 2¼ inches in length. Thus, the width of the upwardly opening compartment for that size package should be slightly larger so as to receive a number of packaged needles of that size.

Figure 4:
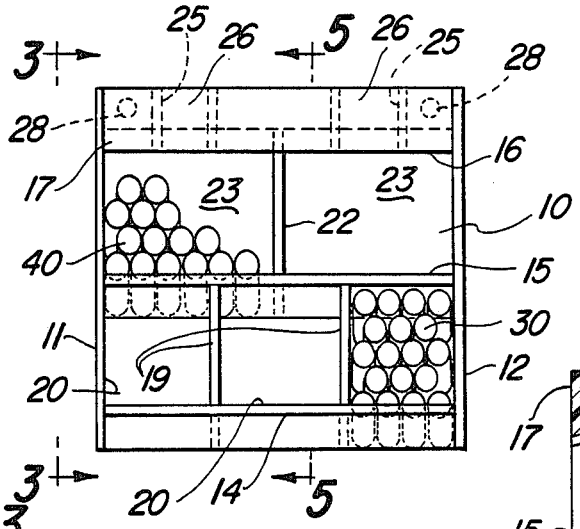
FIG. 4 is a front elevational view of the shelf unit showing the loading of two of the compartments with packages of hypodermic syringes.
Figure 5:
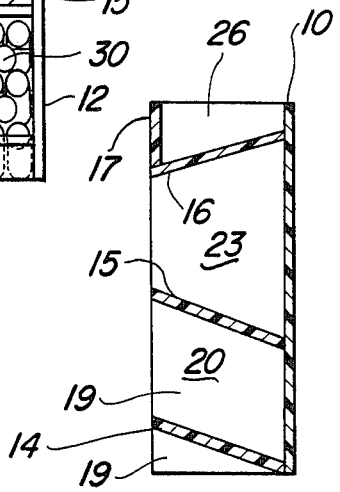
FIG. 5 is a cross-sectional, elevational view taken in the direction of arrows 5—5 of FIG. 4.
Figure 6:
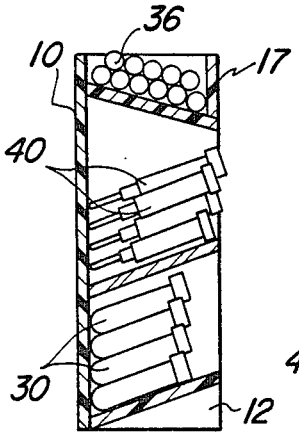
FIG. 6 is a cross-sectional, elevational side view showing adjacent upper and lower compartments loaded with packaged hypodermic syringes, with the adjacent upper compartments loaded with packaged hypodermic syringe needles.

In the case of the syringes, whose lengths vary considerably, these may be stuffed endwise into the respective compartments as illustrated schematically in FIGS. 4 and 6. Although the shelf unit size may vary, a suitable size may be about 15" high, 15" wide and about 5–6" deep, with the shelves and compartment dividers appropriately spaced.

This invention may be further developed within the scope of the following claims. Accordingly, it is desired that the foregoing description be read as merely illustrative of an operative embodiment of this invention and not as a strictly limiting sense.

I claim:

1. A visible storage shelf unit, particularly useful for storing and displaying elongated, cylinder-like articles, comprising:

a rear wall and spaced apart side walls;

vertically spaced apart lower, intermediate and upper shelves extend between and connect to the side walls and to the back walls;

the lower and intermediate shelves each tilting rearwardly downwardly at about the same angle, and the upper shelf tilting forwardly downwardly;

a number of spaced apart, vertically arranged dividers extending between the shelves to divide the spaces between the lower and intermediate shelves and the intermediate and upper shelves into a number of forwardly opening compartments of predetermined size, each adapted for receiving and storing a number of said articles rested upon the rearwardly sloping shelves and extending generally axially parallel to the side walls and the dividers;

the spaces between the shelves being open at the front of the unit for placing articles into and for removing articles from said compartments;

a short, vertical front wall extending between the side walls, above the forward edge of the upper, shelf with a number of vertical dividers extending between the front and rear wall and the upper shelf to form upwardly opening compartments of predetermined size adapted to receive a number of such articles arranged generally parallel to the front and rear walls;

said lower and intermediate shelves each tilting at roughly in the area of 15 degrees to the horizontal and said upper shelf tilting at roughly between about 5–10 degrees to the horizontal;

the width of the side walls being slightly greater than the length of a conventional, predetermined large size, medical syringe packaged within a tubular container, so that each of the front opening compartments between the shelves may store a number of the same size and type packaged syringes, with the packaged syringes in each compartment being of different size or type than those of a different compartment so as to sort the stored syringes;

the distances between the walls of each of the upwardly opening compartments corresponding to about the length of conventional, packaged syringe needles which are normally packaged within elongated, tubular containers, so that each compartment may store a number of packaged syringe needles of the same size or type;

the space between the upper shelf and the intermediate shelf having one vertical divider for dividing such space into two forwardly opening compartments, and the space between the intermediate shelf and the lower shelf having several dividers for forming a number of forwardly opening compartments;

whereby the packaged needles are sorted with respect to size or type within the compartments for rapid selection of a desired syringe needle.

2. A shelf unit as defined in claim 1, and said shelves and side walls and dividers being formed of a substantially transparent plastic sheet material, whereby the syringes in each compartment are readily visible and distinguishable through the side walls, shelves and front wall for simplifying selection of desired syringes

* * * * *